US011834942B2

(12) United States Patent
Terez et al.

(10) Patent No.: US 11,834,942 B2
(45) Date of Patent: Dec. 5, 2023

(54) SIMULTANEOUS GAS-SOLID CHEMICAL STIMULATION OF HYDRAULICALLY FRACTURED OIL WELLS AND GAS-CONDENSATE WELLS IN SHALES

(71) Applicants: Iven Terez, Sugar Land, TX (US); Kenneth Kibodeaux, Houston, TX (US)

(72) Inventors: Iven Terez, Sugar Land, TX (US); Kenneth Kibodeaux, Houston, TX (US)

( * ) Notice: Subject to any disclaimer, the term of this patent is extended or adjusted under 35 U.S.C. 154(b) by 0 days.

(21) Appl. No.: 17/719,532

(22) Filed: Apr. 13, 2022

(65) Prior Publication Data

US 2022/0333474 A1 Oct. 20, 2022

Related U.S. Application Data

(60) Provisional application No. 63/175,108, filed on Apr. 15, 2021.

(51) Int. Cl.
*E21B 33/068* (2006.01)
*E21B 43/27* (2006.01)
*E21B 43/26* (2006.01)

(52) U.S. Cl.
CPC ..... *E21B 43/27* (2020.05); *E21B 33/068* (2013.01); *E21B 43/2607* (2020.05)

(58) Field of Classification Search
CPC ..... E21B 43/27; E21B 43/2607; E21B 33/068
See application file for complete search history.

(56) References Cited

U.S. PATENT DOCUMENTS

| | | | | |
|---|---|---|---|---|
| 8,261,823 | B1 | 9/2012 | Hill | |
| 8,893,793 | B2 | 11/2014 | Lockhart | |
| 9,347,301 | B2 | 5/2016 | Gao | |
| 9,453,399 | B2 | 9/2016 | Enis | |
| 9,664,023 | B1 | 5/2017 | Griffin | |
| 9,784,086 | B2 | 10/2017 | Zhao | |
| 10,077,606 | B2 * | 9/2018 | Hall | C09K 8/524 |
| 10,202,830 | B1 | 2/2019 | Griffin | |
| 10,655,441 | B2 | 5/2020 | Kuhlman | |
| 2014/0345880 | A1 | 11/2014 | Enis | |
| 2017/0356281 | A1 * | 12/2017 | Brady | C09K 8/84 |
| 2019/0186247 | A1 * | 6/2019 | Lau | E21B 43/166 |
| 2020/0056088 | A1 * | 2/2020 | Veldman | C09K 8/03 |
| 2020/0056464 | A1 * | 2/2020 | Li | C09K 8/64 |
| 2020/0317993 | A1 * | 10/2020 | Walker | E21B 43/27 |

* cited by examiner

*Primary Examiner* — Silvana C Runyan
(74) *Attorney, Agent, or Firm* — OMNIVAULT LLC; Robert Denis

(57) ABSTRACT

A method for providing simultaneous gas-solid or gas-solid slurry mixture chemical well stimulation of hydraulically fractured oil and gas-condensate wells in shales according to the present invention is disclosed. Injected with gas, chemicals having interacted with in-situ water alter rock properties near the fractures/fissures allowing liquids to move better, thus enlarging the swept volumes and recovery factor. The injected gas-solid mixture or gas-solid slurry mixture reopens fractures that were closed previously due to well depletion and pressure dropping below fracture closure pressure. The process results in greater relative permeability (flow through the larger pores) which leads to more mobile fluids and greater production rates.

10 Claims, 4 Drawing Sheets

SIMULTANEOUS GAS-SOLID CHEMICAL STIMULATION OF HYDRAULICALLY FRACTURED OIL WELLS AND GAS-CONDENSATE WELLS IN SHALES

CROSS-REFERENCE TO RELATED APPLICATION

This application claims priority to U.S. Provisional Patent Application No. 63/175,108, titled "Simultaneous Gas-Solid Chemical Stimulation of Hydraulically Fractured Oil Wells and Gas-Condensate Wells in Shales," and filed on Apr. 15, 2021. The entire application is incorporated herein by reference in its entirety.

TECHNICAL FIELD

This application relates in general to a method for providing a gas extraction, and more specifically, to a system and method for providing simultaneous gas-solid or gas-solid slurry mixture chemical well stimulation of hydraulically fractured oil and gas-condensate wells in shales. It applies as an Enhanced Oil and Gas recovery (EOR or EOGR) method in huff-and-puff application in a single wellbore.

BACKGROUND

Shales in the oil and gas-condensate windows are attractive because they have large quantities of high-quality oils and condensates. However, they always suffer from low recovery factors, for multiple technical reasons. First, liquid compressibility is low compared to gas, causing rapid rate decline.

Second, liquid mobility is low compared to gas, leading to very small production rates. The liquid mobility term from Darcy's Law has three elements ($K_{ro}*K/\mu_o$), all three of which lead to poor productivity for oil-window shales and still poor for gas-condensate window shales as well.

1. Rock permeability K is extremely low for both shales.
2. Oil/liquid (oleic liquid) viscosity $\mu_o$ is high compared to the vapor in shale gas.
3. Relative permeability for oil $K_{ro}$ is lower than for gas (gas resides in the larger pore networks). Furthermore, at some moment pressure will drop below bubble point for black and volatile oils, or dew point for gas-condensate fluids, at the fracture face. The exsolved fluid will block some pores, reducing relative permeability at the fracture face, creating a flow barrier to oil or gas-condensate production.

This suggests the need for an effective stimulation/enhancement technique that allows the oil-in-place to more effectively flow through the rock to the fracture. Overall low recovery in oil-window and gas-condensate shales has triggered a need for production enhancement methods. It is well known that surface-active agents (e.g., surfactant chemicals, nanoparticles, etc.) can alter rock wettability, enabling oil to move from the tiny shale pores against the oil-wet solids in the shales into the larger pores, which increases oil mobility through an increase in the oil relative permeability. However, surfactants are customarily injected dissolved into large quantities of water, and injecting water causes well productivity problems in shales. The shale's fracture systems were initially created by injection of many thousands of gallons of water. Much of this water remains in the fracture system (which is itself a porous medium) and reduces oil mobility in the fractures. Also, some of this water imbibes into the rockface, reducing the oil relative permeability, and thus reducing the reservoir's oil productivity. These two problems would be exacerbated by the injection of any more water.

Therefore, there is a need for a method to inject surface active agents through the shale well and its fracture system that does not require injection of large quantities of water. A need also exists for a system and method for providing simultaneous gas-solid or gas-solid slurry mixture chemical well stimulation of hydraulically fractured oil and gas-condensate wells in shales. The present invention attempts to address the limitations and deficiencies in prior solutions according to the principles and example embodiments disclosed herein.

SUMMARY

In accordance with the present invention, the above and other problems are solved by providing a system and method for a simultaneous gas-solid or gas-solid slurry mixture chemical well stimulation of hydraulically fractured oil and gas condensate wells in shales according to the principles and example embodiments disclosed herein.

In one embodiment, the present invention is a method for providing simultaneous gas-solid or gas-solid slurry mixture chemical well stimulation of hydraulically fractured oil and gas condensate wells in shales The foregoing has outlined rather broadly the features and technical advantages of the present invention in order that the detailed description of the invention that follows may be better understood. Additional features and advantages of the invention will be described hereinafter that form the subject of the claims of the invention.

It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features that are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

Referring now to the drawings in which like reference numbers represent corresponding parts throughout.

DETAILED DESCRIPTION

Figure 1:
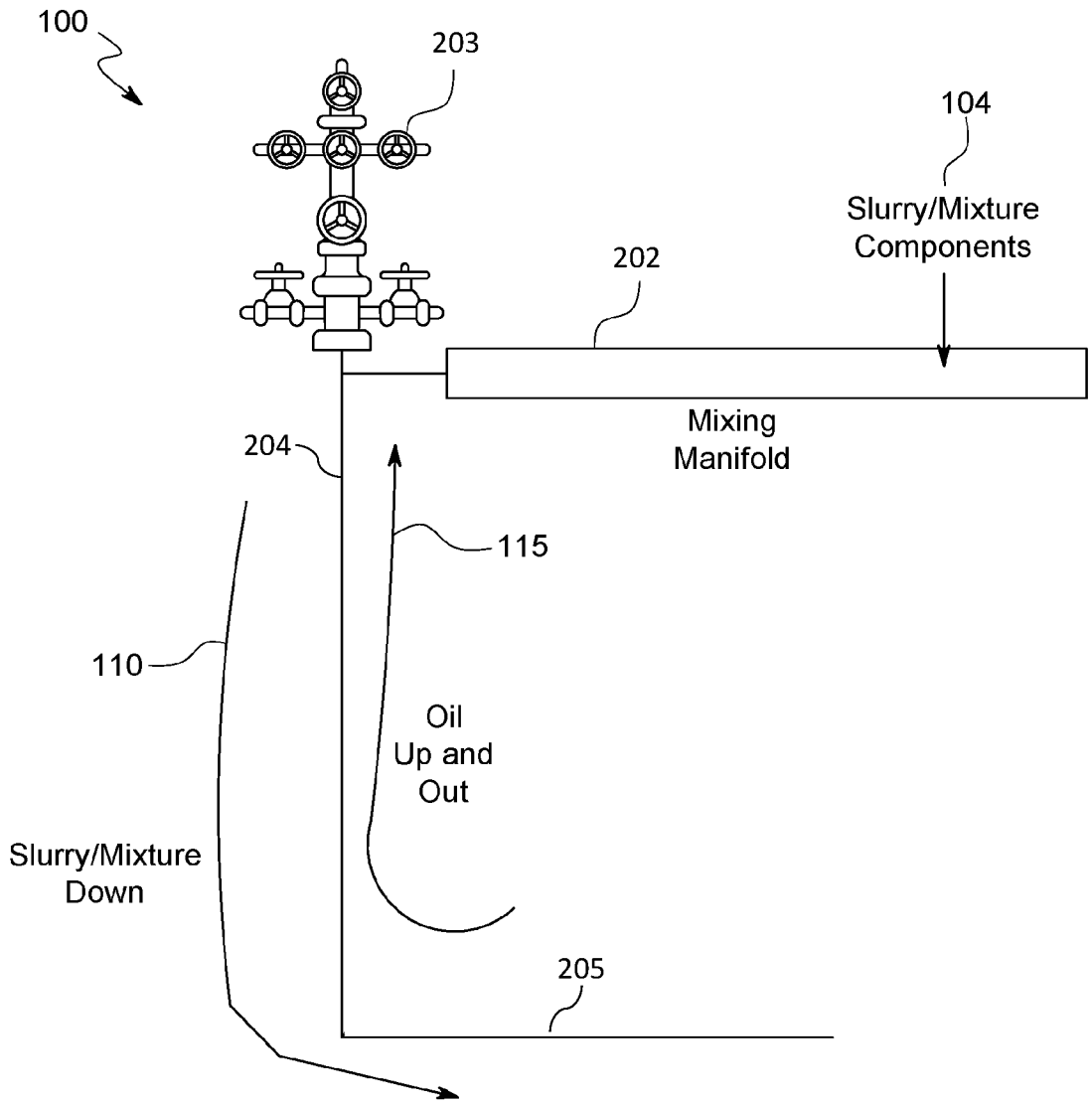
FIG. 1 illustrates an example embodiment of simultaneous gas-solid or gas-solid slurry mixture chemical well stimulation of hydraulically fractured oil and gas condensate wells in shales according to the present invention.

This application relates in general to a method for providing oil extraction, and more specifically, to a method for providing simultaneous gas-solid or gas-solid slurry mixture chemical well stimulation of hydraulically fractured oil and gas-condensate wells in shales according to the present invention. It is referred as an Enhanced Oil and Gas Recovery (EOR or EOGR) method in huff-and-puff application in a single wellbore.

The method sets-up a mixing manifold at the surface near the wellhead of a horizontal well that penetrates an oil or gas-condensate window shale and has been hydraulically fractured through the shale, uses a gas compressor to flow gas into a gas-solid mixing manifold to create a mixture of gas and solids to inject through the wellhead and fill the well and fracture network with the gas-solid mixture or gas-solid slurry mixture, stops the gas-solid mixture flow by shutting in the well to create a soak period in order to allow the chemicals to interact with in-situ water and the rock to be treated by chemicals and water, and opens the well to allow the well to produce, and pressure of fluid in the fractures to drop. Oil and gas from the reservoir will flow into the well and to the surface during this period.

In another aspect of the present invention, the method further repeats the use of a gas compressor to inject the gas and solids into the wellhead and continue the extraction.

In another aspect of the present invention, the mixture of gas and solids comprises a gas-solid slurry mixture of solids of nanoparticles and solid surfactants, where the amount of one of these components can be as low as zero.

In another aspect of the present invention, the soak period has a duration of as low as zero minutes.

In another aspect of the present invention, the repeated injection of gas and solids occurs after a pre-defined outflow time period.

Various embodiments of the present invention will be described in detail with reference to the drawings, wherein like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

In describing embodiments of the present invention, the following terminology will be used. The singular forms "a," "an," and "the" include plural referents unless the context clearly dictates otherwise. As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. As used herein, the singular forms "a," "an," and "the" are intended to include the plural forms as well, unless the context clearly indicates otherwise.

It further will be understood that the terms "comprises," "comprising," "includes," and "including" specify the presence of stated features, steps or components, but do not preclude the presence or addition of one or more other features, steps or components. It also should be noted that in some alternative implementations, the functions and acts noted may occur out of the order noted in the figures. For example, two figures shown in succession may in fact be executed substantially concurrently or may sometimes be executed in the reverse order, depending upon the functionality and acts involved.

The terms "individual" and "user" refer to an entity, e.g., a human, using a system and method for providing simultaneous gas-solid or gas-solid slurry mixture chemical well stimulation of hydraulically fractured oil and gas-condensate wells in shales according to the present invention. The term "user" herein refers to one or more users.

The term "invention" or "present invention" refers to the invention being applied for via the patent application with the title "Simultaneous Gas-Solid Chemical Stimulation of Hydraulically Fractured Oil Wells and Gas-Condensate Wells in Shales." Invention may be used interchangeably with oil extraction.

In general, the present disclosure relates to a system and method for providing simultaneous gas-solid or gas-solid slurry mixture chemical well stimulation of hydraulically fractured oil and gas-condensate wells in shales according to the present invention. To better understand the present invention, FIG. 1 illustrates an example embodiment of simultaneous gas-solid or gas-solid slurry mixture chemical well stimulation of hydraulically fractured oil and gas-condensate wells 100 via its wellhead 101 to extract oil and gas from within shales according to the present invention. The present invention does so via numerous improvements: simultaneous gas-solid or gas-solid slurry mixture injection 110 delivers solid chemicals deeper in fractures and fissures in comparison with aqueous slug injection of the same or similar chemicals; injected solid chemicals (nanoparticles, surfactants, etc.), once interacted with in-situ water, change the relative permeability of the rock allowing the oil and gas to flow through larger pores; and injected gas-solid mixture or gas-slurry mixture re-opens a number of fractures that were closed previously due to well depletion and pressure dropping below fracture closure pressures. The process removes some oil and gas condensate 115, and the greater relative permeability (flow through the larger pores) means more mobile fluids.

Figure 2:
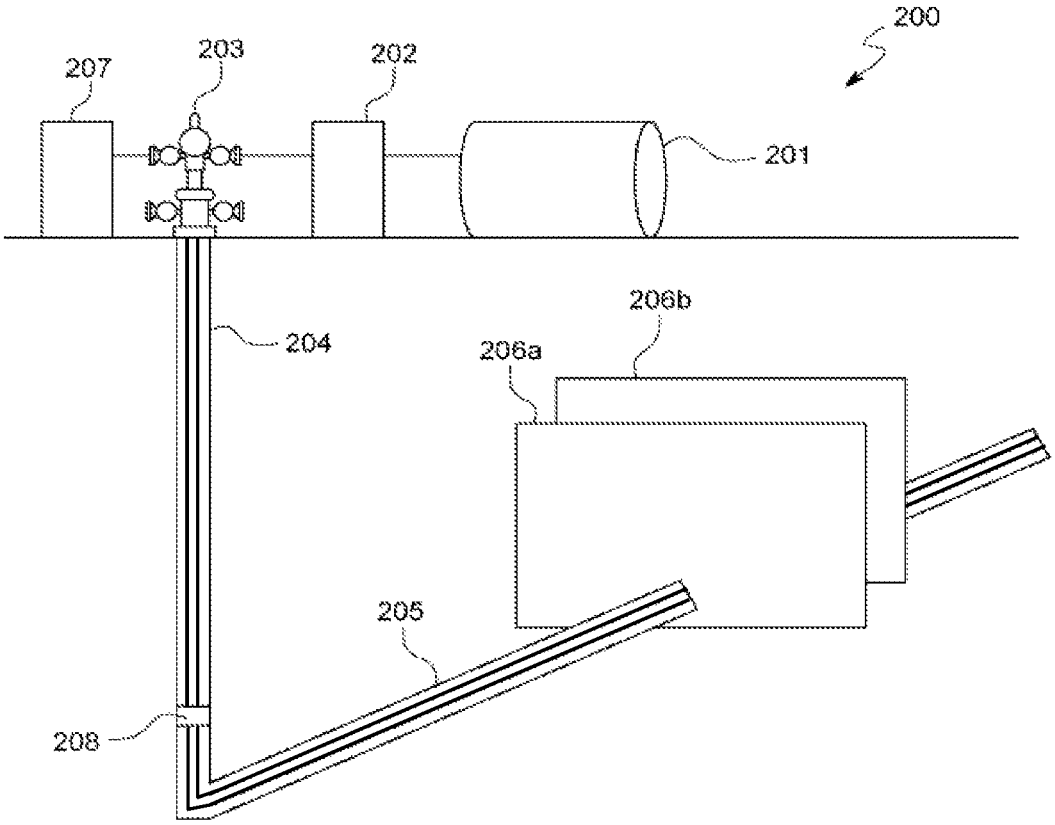
FIG. 2 illustrates another example embodiment of simultaneous gas-solid or gas-solid slurry mixture chemical well stimulation of hydraulically fractured oil and gas-condensate wells in shales according to the present invention.

FIG. 2 illustrates another example embodiment of simultaneous gas-solid or gas-solid slurry mixture chemical well stimulation of hydraulically fractured oil and gas condensate wells in shales according to the present invention. FIG. 2 shows the apparatus for the invention. Gas compressor 201 (A) feeds gas into a specialized gas-solid or gas-slurry mixing manifold 202 (B) where solids (or a slurry) are introduced into high-pressure gas to form gas-solid or gas-slurry mixture. (A small amount of water may be introduced within manifold 202 (B), if desired.) The resulting gas-solid or gas-slurry mixture flows though the wellhead 203 (C), down through the tubing pipe in the well's vertical 204 (D) section with installed packer 208 (H) and possible additional horizontal liner 204 (D) sections and fills the fractures 206*a* and 206*b* (F), while the wellhead 203 (C) is closed. During the soak period injection is stopped while the wellhead 203 (C) remains closed, thereby shutting-in the well while the reservoir rock is being treated by injected chemicals. During the flow-out period, there continues to be no injection, but the wellhead 204 (C) is open to the production system 207 (G) to accept flow of downhole fluids.

As stated above, shales in the oil and gas-condensate windows are attractive because they carry large quantities of high-quality oil and condensates. However, they always suffer from low recovery factors, for multiple technical reasons. First, liquid compressibility is low compared to gas, causing rapid rate decline. Second, oil mobility is low compared to gas, leading to very small production rates. The oil mobility term from Darcy's Law has three elements ($K_{ro}$*K/$\mu_o$) all three of which mean poor productivity for oil-window shales.

1. Rock permeability K is extremely low for both shales.

2. Oil (oleic liquid) viscosity $\mu_o$ is high compared to the vapor in shale gas.

3. Relative permeability for oil $K_{ro}$ is lower than for gas (gas resides in the larger pore networks). Furthermore, at some moment pressure will drop below bubble point for black and volatile oils, or dew point for gas-condensate fluids, at the fracture face. The exsolved fluid will block some pores, reducing relative permeability at the fracture face, creating a flow barrier to oil or gas-condensate production.

This suggests the need for an effective stimulation/enhancement technique that allows the oil-in place to flow more effectively to the fracture. The invention claimed here solves this problem. The invention includes all the advantages of the current gas injection projects but adds numerous other very effective recovery mechanisms.

Introducing reservoir rock to a solid-gas mixture (injecting cold or pre-heated gas along with added solid nanoparticles, surfactants, etc.) will include all the advantageous recovery mechanisms of the current gas method, plus many others added, for improved success in a type of reservoir for which recovery improvement is in great demand.

The claimed invention differs from what currently exists. It introduces chemical treatment; it is a cyclic process, and it is designed to alter the rock properties near the fracture rather than attempting to inject gases directly into the reservoir further and rely on very slow molecular diffusion.

This invention is an improvement on what currently exists. It is a cyclic process, and it is designed to alter rock near the fracture rather than injecting gases directly deeper into the reservoir and rely on slow molecular diffusion.

The potential for success of the currently practiced gas cyclic-injection process is severely limited due to the slow diffusion of the gas, the limited depth of invasion of the injected gas, the limited amount of oil components the gas can dissolve, and the limited driving force for fluids to flow into the fracture from the reservoir.

Injected with gas chemicals once interacted with in-situ water alters rock properties near the fracture allowing liquids to move better, thus enlarging the swept volumes and recovery factor.

Gas-solid mixture or gas-solid slurry mixture is injected with zero or very little water, which would otherwise block pores in the rock and reduce mobility of liquid oil, and in turn reduce oil production rate and its ultimate oil recovery. The process removes additional oil and gas-condensate, and the greater relative permeability (flow through the larger pores) means more mobile fluids. Also, it can produce petroleum fluids to the surface from underground geological reservoirs.

The Version of the Invention Discussed Here Includes:

1. Set-up mixing manifold at surface near wellhead of horizontal well that penetrates an oil or gas-condensate window shale and has been hydraulically fractured through the shale.

2. Flow-in cycle: Use the gas compressor to flow gas into a gas-solid mixing manifold to create a mixture of gas and solids (nanoparticles, solid surfactants, etc.) or gas-solid slurry mixture to inject through the wellhead and fill the well and fracture network with the pressurized gas-solid mixture or gas-solid slurry mixture.

3. Soak period: Stop gas-solid mixture flow by shutting-in the well, allowing the chemicals to interact with in-situ water and the rock to be treated by chemicals and water. This is called the "soak" period. (Duration of this period can be as low as zero minutes.)

4. Flow-out cycle: Open the well, allowing the well to produce and pressure of fluid in the fractures to drop. Oil and gas from the reservoir will flow into the well and to the surface during this period.

5. After the desired amount of flow-out time has elapsed, go back to step 2.

Relationship Between the Components:

Gas compressor (A) 201 feeds gas into a specialized mixing manifold (B) 202 where solids are introduced into the high-pressure gas along with a small amount of water (whose amount can be as low as zero) to form a gas-solid mixture. The gas-solid mixture or gas-solid slurry mixture flows though the wellhead (C) 203, down through the tubing pipe in the well's vertical section (D) 204 with installed packer (H) 208 and possible additional horizontal liner (E) 205 sections and fills the fractures (F) 206*a-b*. During the soak period the wellhead (C) 203 is closed, and the well is shut-in while the reservoir rock is being treated by injected chemicals. During the flow-out period, the wellhead (C) 203 is open to the production system (G) 207 to accept flow of downhole fluids.

How the Invention Works:

The invention works through exposing the entire well and fracture system 200 to the gas-solid mixtures in a way that cycles between low and high pressures with chemical rock alteration occurring during the period of shut-ins between cycles. This causes an increased and longer-lived driving force for flow from reservoir to well, increases the amount of oil produced, increases fluid mobility for greater flow to the well, and improves the recovery process.

How to Use the Invention:

To maximize production from a fractured well in an oil or gas-condensate window shale, this process should be applied. Also, it produces petroleum fluids to the surface from underground geological reservoirs.

Figure 3:
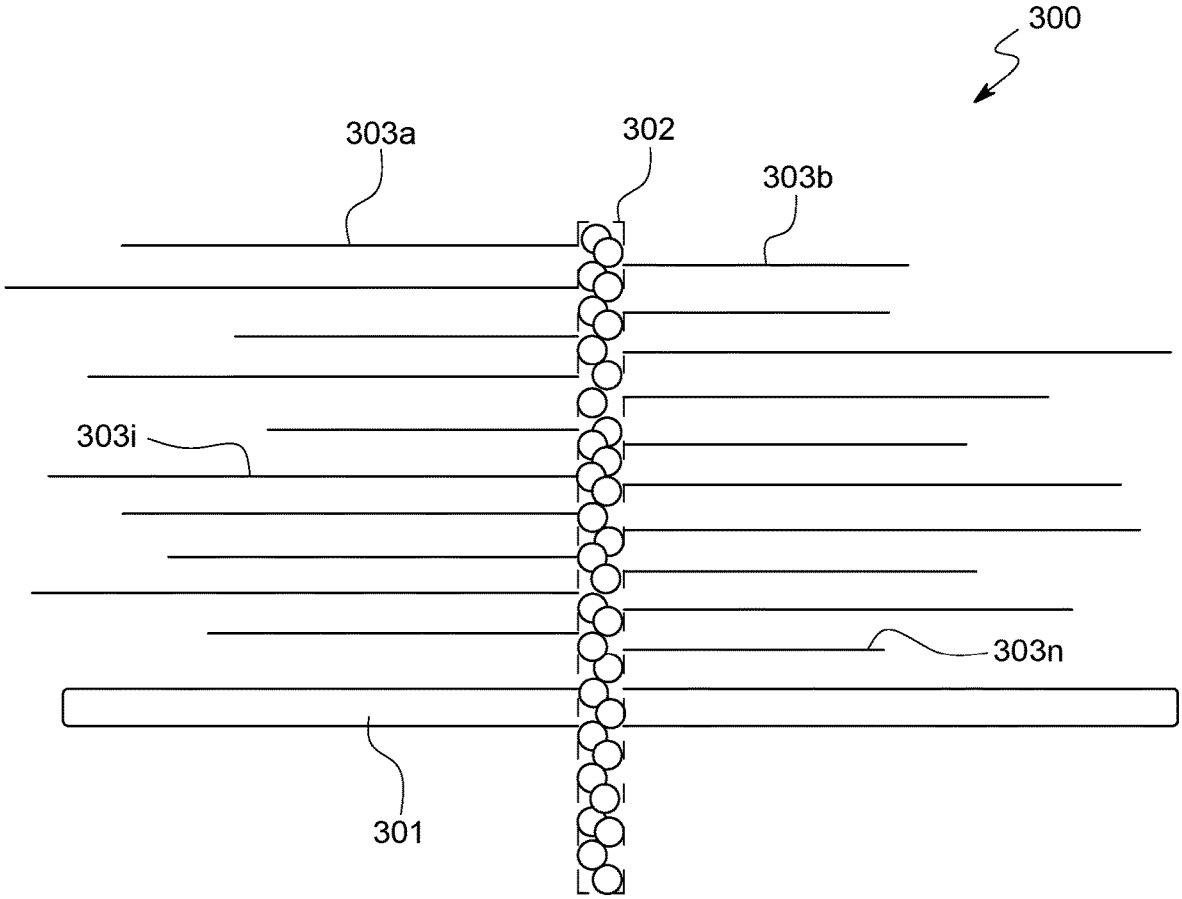
FIG. 3 illustrates an example embodiment of a single hydraulic fracture used in simultaneous gas-solid or gas-solid slurry mixture chemical well stimulation of hydraulically fractured oil and gas condensate wells in shales according to the present invention.

FIG. 3 illustrates an example embodiment of a portion of the subsurface fracture system around a single hydraulic fracture used in simultaneous gas-solid or gas-solid slurry mixture chemical well stimulation of hydraulically fractured oil and gas-condensate wells in shales according to the present invention. FIG. 3 depicts one exemplar out of numerous hydraulically-induced fractures located along the length of a horizontal wellbore, where A 301 represents the horizontal wellbore, B 302 represents a single fracture lobe held open by proppant particles, and C 303*a-n* represents the network of unpropped natural fractures that emanate out from the man-made fracture and into the reservoir rock. Gas with chemicals injected into wellbore A 301 fill flow to fill the void space in the man-made fractures such as B 302 and then proceed to fill the connected network of natural fractures C 303*a-n*. Note that there are often dozens of fractures like B created along a single horizontal wellbore A 301.

Figure 4:
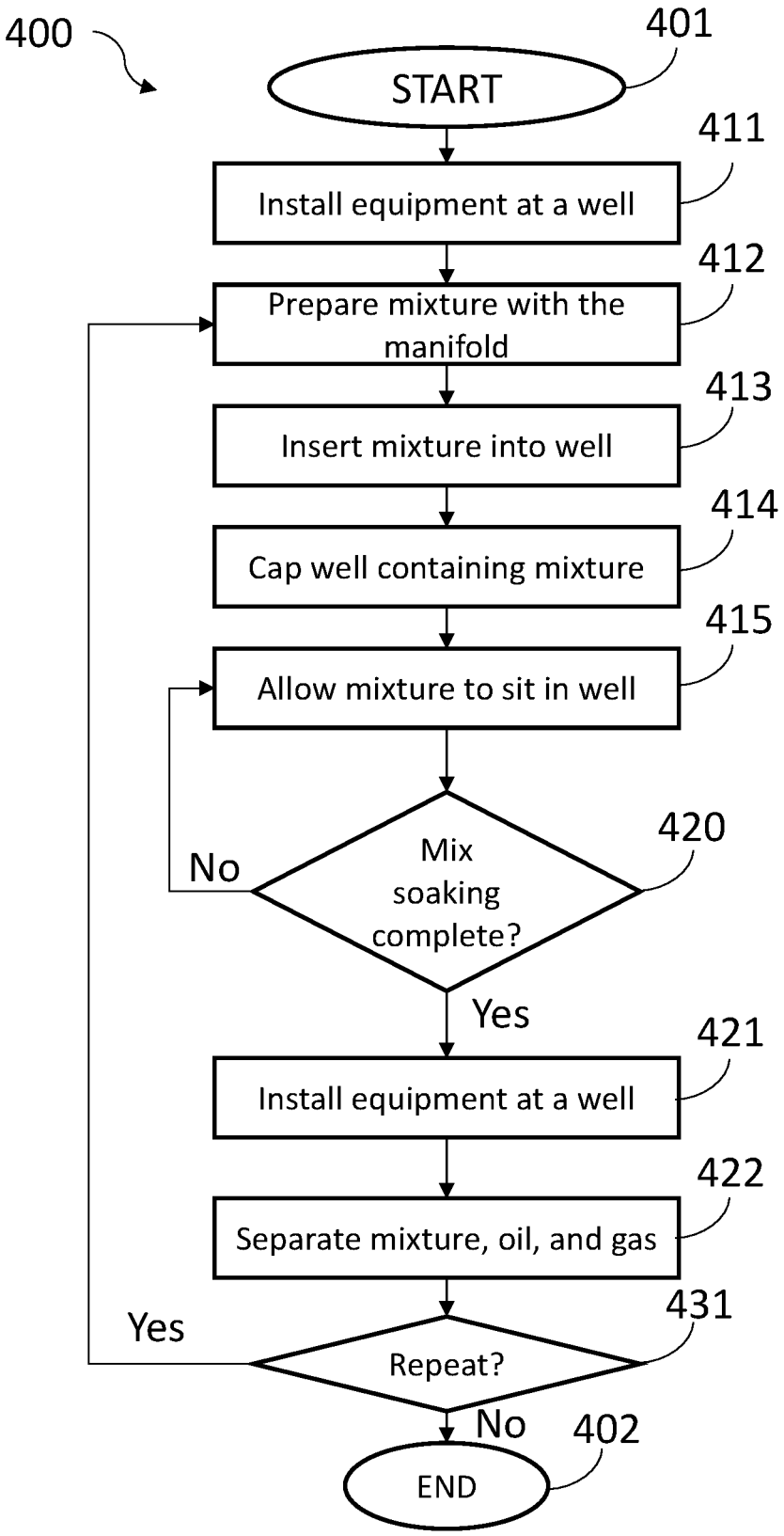
FIG. 4 illustrates a flowchart for an example embodiment of a method of simultaneous gas-solid or gas-solid slurry mixture chemical well stimulation of hydraulically fractured oil and gas-condensate wells in shales according to the present invention.

FIG. 4 illustrates a flowchart for an example embodiment of a method of simultaneous gas-solid or gas-solid slurry mixture chemical well stimulation of hydraulically fractured oil and gas-condensate wells in shales according to the present invention. The process 400 begins 401 and a manifold and related equipment is installed at a well in step 411. A slurry mixture is prepared in the manifold in step 412 by mixing gas from a compressor (not shown) with chemicals 104 and, if desired, a small amount water as disclosed in detail above.

The slurry mixture is injected into the well in step 413 and the well is then shut-in in step 414. The slurry mixture is permitted to remain in the well in step 415 until test step 420 has determined that the slurry mixture has soaked the fractures in the shale, releasing the oil and gas material.

When test step 420 determines that the slurry mixture has completed its conditioning, the well is reopened, and the mix of material is extracted in step 421. The mix of material contains both the slurry mixture and the oil and gas released in the extraction process 400. The oil and gas material and the extracted slurry mixture are separated in step 422 for capture and transmission for consumption.

Once the oil and gas material has been extracted, the test step 431 determines if the process is to repeat to extract additional oil and gas, and if so, the process 400 returns to step 412 to perform an additional extraction cycle; otherwise the process 400 ends 402.

Even though particular combinations of features are recited in the present application, these combinations are not intended to limit the disclosure of the invention. In fact, many of these features may be combined in ways not specifically recited in this application. In other words, any of the features mentioned in this application may be included in this new invention in any combination or combinations to allow the functionality required for the desired operations.

No element, act, or instruction used in the present application should be construed as critical or essential to the invention unless explicitly described as such. Further, the phrase "based on" is intended to mean "based, at least in part, on" unless explicitly stated otherwise.

What is claimed is:

1. A method for providing simultaneous gas-solid mixture chemical well stimulation of hydraulically fractured oil and gas-condensate wells in shales, the method comprises:

setting-up a gas-solid mixing manifold at surface adjacent a wellhead of a horizontal well that penetrates an oil or gas-condensate shale reservoir, the shale reservoir comprising a plurality of networks, the plurality of networks comprising at least one of a plurality of hydraulic fractures or a plurality of natural fractures;

using a gas compressor to flow gas into the gas-solid mixing manifold to create a gas-solid mixture, the gas-solid mixture comprising of a gas and a plurality of solids, the plurality of solids comprising at least one of a plurality of nanoparticles or a plurality of surfactants, to inject through the wellhead and fill the well and the plurality of networks with the gas-solid mixture;

injecting the gas-solid mixture through the wellhead;

filling the well and the plurality of networks with the gas-solid mixture;

stopping the gas-solid mixture injection;

shutting in the well for a soak period of time in order to allow a plurality of chemicals of the gas-solid mixture to interact with existing in-situ water and shale to be treated by a chemical-water mixture formed from a combination of the existing in-situ water and the plurality of chemicals;

opening the well to adjust a pressure of fluid contained within the reservoir; and flowing hydrocarbons from the reservoir into the well and to the surface.

2. The method according to claim 1, wherein the soak period has a duration of less than a minute.

3. The method of claim 1, further comprising performing the steps simultaneously in a plurality of different locations.

4. The method of claim 1, further comprising performing the step of injecting at a first location while performing the step or allowing to soak or produce in a second location.

5. The method of claim 1, wherein the gas-solid mixture does not comprise any water.

6. The method of claim 1, wherein the gas-solid mixture comprises a gas-solid slurry mixture.

7. The method of claim 1, wherein the gas-solid mixture comprises a cold gas.

8. The method of claim 1, wherein the gas-solid mixture comprises a pre- heated gas.

9. The method according to claim 1, wherein the method is repeated until a desired amount of hydrocarbons is from the reservoir is extracted.

10. The method according to claim 9, wherein the method is repeated after a pre-defined out flow time period.

* * * * *